United States Patent [19]

Blackman

[11] Patent Number: 5,002,401

[45] Date of Patent: Mar. 26, 1991

[54] ARTICLE HOLDER AND CARRIER

[76] Inventor: Marianne Blackman, 12120 Willow La., No. 1116, Overland Park, Kans. 66213

[21] Appl. No.: 488,864

[22] Filed: Mar. 5, 1990

[51] Int. Cl.[5] ..... B65D 30/22

[52] U.S. Cl. ..... 383/38; 383/4; 383/75; 383/117; 383/119; 383/39; 206/372; 206/523; 190/1; 190/107; 190/109; 190/127; 190/901; 150/112

[58] Field of Search ..... 383/4, 38, 39, 40, 75, 383/117, 119; 190/1, 107, 109, 114, 127, 901; 150/112, 116; 206/371, 372, 373, 523, 591, 593, 594

[56] References Cited

U.S. PATENT DOCUMENTS

| | | | |
|---|---|---|---|
| 36,710 | 10/1862 | Hamlin | 383/39 |
| 687,412 | 11/1901 | Trescott . | |
| 1,217,357 | 2/1917 | Sparrow | 383/39 |
| 1,679,101 | 7/1928 | Sternthal | 206/372 X |
| 1,683,678 | 9/1928 | Kitterman et al. . | |
| 1,818,030 | 8/1931 | Arnold . | |
| 2,205,205 | 6/1940 | King | 190/901 X |
| 2,466,208 | 4/1949 | Chanslor et al. . | |
| 2,621,696 | 12/1952 | Barnes | 190/107 X |
| 2,679,877 | 6/1954 | Leggett | 383/39 X |
| 2,731,997 | 1/1956 | Muth et al. | 383/72 X |
| 2,795,260 | 6/1957 | Perry . | |
| 3,797,043 | 3/1974 | Brument . | |
| 4,180,112 | 12/1979 | Bovet . | |
| 4,337,812 | 7/1982 | Trinkner | 383/75 X |
| 4,423,834 | 1/1984 | Rush . | |
| 4,461,332 | 7/1984 | Parkhurst | 206/523 X |
| 4,463,848 | 8/1984 | Parker . | |
| 4,489,815 | 12/1984 | Martinez et al. . | |
| 4,555,018 | 11/1985 | Cho . | |
| 4,646,804 | 3/1987 | Damiano . | |
| 4,648,505 | 3/1987 | Belmondo . | |
| 4,685,570 | 8/1987 | Medow . | |
| 4,738,547 | 4/1988 | Brown | 383/39 |

FOREIGN PATENT DOCUMENTS

| | | | |
|---|---|---|---|
| 512634 | 11/1930 | Fed. Rep. of Germany | 383/38 |
| 447233 | 12/1912 | France | 383/75 |

*Primary Examiner*—Stephen Marcus
*Assistant Examiner*—Jes F. Pascua
*Attorney, Agent, or Firm*—Litman, McMahon & Brown

[57] ABSTRACT

An article holder and carrier includes a box-like container having fabric walls reinforced with soft, shock-absorbing material and adapted to disconnect along an edge between two walls and around three edges of a base panel to unfold to a flat position for access to articles held within the holder and carrier. Access is also provided by a drawstring closure at one end of the article holder and carrier and is further provided by unfolding the base panel at another end. The article holder and carrier includes pockets or other compartments sewn to an inner surface of the fabric walls and base panel with the pockets or compartments being adapted to hold the articles against the fabric walls providing rigidity and support therefor.

3 Claims, 2 Drawing Sheets

ARTICLE HOLDER AND CARRIER

BACKGROUND OF THE INVENTION

1. Field of the Invention

The present invention relates generally to holders for small items and in particular to a school box for holding and carrying school supplies such as pencils, crayons, glue, scissors and coins.

2. Description of the Prior Art

Bags, packs and other containers for holding and organizing small articles have been in use for many years. Containers for holding and transporting items such as school supplies, cosmetics and other personal items are often made of soft materials such as fabric or flexible plastic. The advantages of utilizing fabric, plastic or a mixture of the two materials for the container body include washability and durability. Such materials are usually inexpensive and closure devices such as zippers, snaps and hook-and-loop fasteners are easily sewn or otherwise adhered to materials. The use of fabric for the container body also makes it easy to provide compartments within the container by simply sewing pockets to the container walls.

However, there are disadvantages to containers made from flexible materials. Because of the flexibility of the container, objects inside often shift during transport, even if located in pockets, unless each pocket is individually secured by a snap, zipper or hook-and-loop closure. Because the container is soft and flexible, the articles within are more likely to be damaged if the container is dropped or impacted against another object during transport. If not completely enclosed within individual compartments, articles within the container may damage other articles in the container upon impact with the ground or other objects.

Furthermore, access to the items in a fabric container may be limited to a single opening at one end of the container, restricting the number and size of compartments within the container. The prior art includes material bags or packs that fold open to a flat configuration allowing for access to the entire inner surface of the pack. However, such packs do not provide a user with an option to open either end of the pack without unfolding the entire pack.

SUMMARY OF THE INVENTION

The article holder and carrier of this invention is a box-like container having two-ply fabric walls or panels and a drawstring closure at one end. Pockets are sewn or otherwise attached to the inner surface of the fabric walls that form the sides of the container and a compartment for coins or other small objects is sewn to a base panel that is opposite the drawstring closure. The pockets are sized to generally custom fit around the articles to be stored in the container so that the articles are held against the fabric walls and provide rigid support therefore. The pockets are also configured such that the articles fit compactly within the container. Stiffening material and foam-like shock absorbant material are placed between the two layers of the fabric walls to provide additional rigidity and protection for the articles held within the container.

The walls or panels of the fabric container are adapted to disconnect along an edge between two of the fabric walls and around three edges of the base panel to unfold to a flat position allowing a user to easily access all the articles held within the container pockets or compartment. The base panel alone may be disconnected from three of the side panels allowing a user to access the coin compartment without having to completely unfold the container. The container may also be opened by loosening the drawstring closure, providing another access to the articles in the pockets.

OBJECTS OF THE INVENTION

Therefore, the objects of the present invention are: to provide an article holder and carrier and particularly a holder and carrier that organizes school supplies such as pencils, pens, crayons, scissors, glue, and coins and secures the supplies in a compact manner during transport and yet provides easy access to all the articles therewithin; to provide such an article holder and carrier having walls made from a soft material such as fabric or flexible plastic that will not break if the holder and carrier is dropped or impacts with other objects; to provide such an article holder and carrier that contains compartments for the individual articles held within; to provide such an article holder and carrier adapted to unfold for easy access to each compartment therein; to further provide such a holder and carrier that also opens from both the top and the bottom of the carrier without unfolding so as to allow access to particular items therein; to provide such an article holder and carrier having compartments adapted to hold the articles against the walls of the carrier, providing rigid support for the walls; to provide such a holder and carrier that includes a drawstring closure at one end thereof; to provide such an article holder and carrier that is relatively easy to use, inexpensive to construct and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
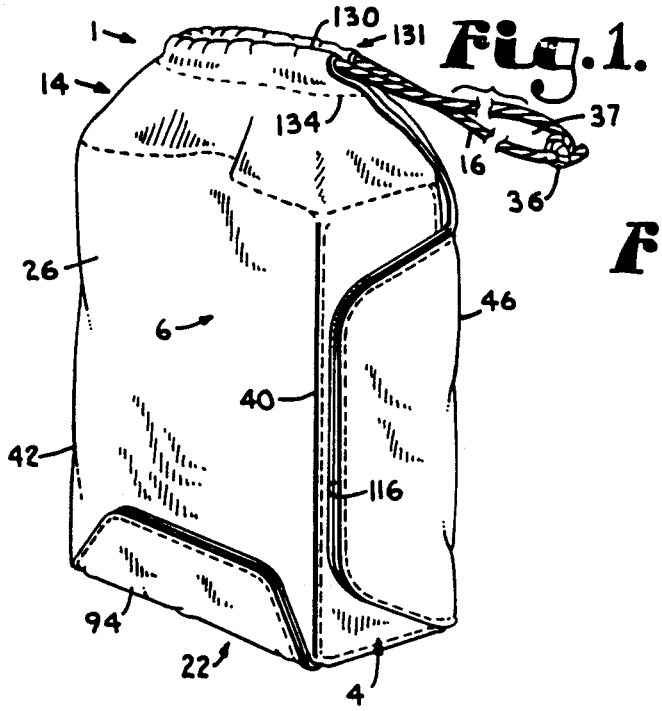
FIG. 1 is a perspective view of an article holder and carrier in accordance with the present invention shown in and article carrying position.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in detail and particularly to FIGS. 1 through 7, an article holder and carrier of this invention, is a box-like container generally designated by the reference numeral 1 for organizing and securely holding articles such as school supplies generally designated by the reference numeral 3 and includes wall means such as side walls or panels 4, 6, 8 and 10, and base wall or panel 12. A top portion generally designated by the reference numeral 14 integral with wall panels 4, 6, 8 and 10 includes a drawstring 16. A side wall flap 20 is integral with wall panel 10 and a base flap 22 is integral with base panel 12.

Figure 2:
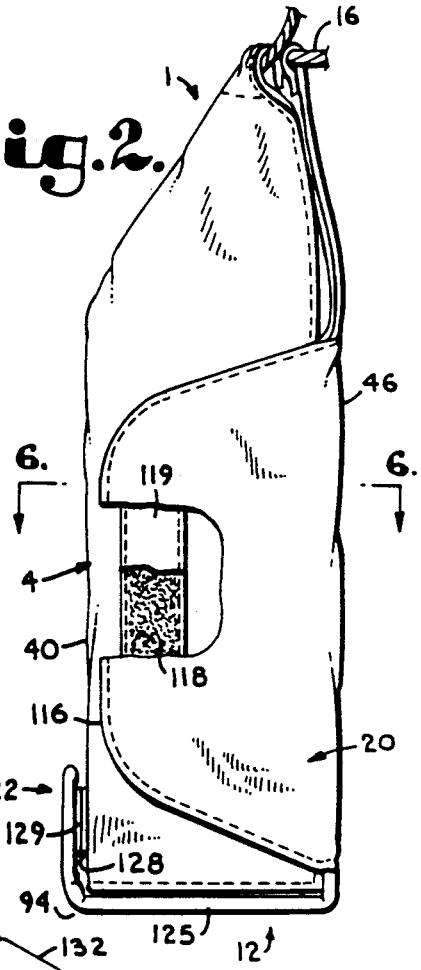
FIG. 2 is side elevational view of the article holder and carrier with a portion broken away to show the detail thereof.
Figure 6:
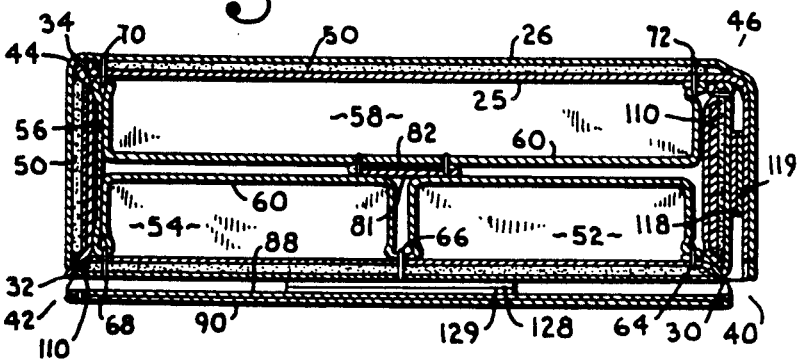
FIG. 6 is a cross-sectional view of the article holder and carrier taken along 6—6 of FIG. 2.
Figure 7:
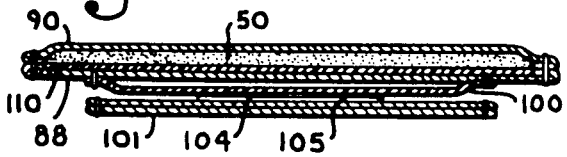
FIG. 7 is a cross-sectional view of the article holder and carrier taken along 7—7 of FIG. 4.

The wall panels 4, 6, 8 and 10, top portion 14 and side flap 20 are constructed by sewing a generally rectangular inner sheet of material 25 to an identically shaped outer sheet of material 26. Sheets 25 and 26 are made from a washable fabric such as cotton or a cotton/-polyester blend. It is forseen that the sheets may also be made from a washable, flexible plastic material. The hingable panels 4, 6, 8 and 10 and flap 20 are formed by sewing sheet 25 to sheet 26 along parallel seams 30, 32, 34 and 36 respectively corresponding with outer edges 40, 42, 44 and 46 of the article holder and carrier 1 when in a folded article carrying position as shown in FIGS. 1, 2 and 6. Sheets 25 and 26 are also sewn together at a seam 48 perpendicular to seams 30, 32, 34 and 36 separating the panels 4, 6, 8 and 10 from the top portion 14.

Shock absorbing means such as flexible inserts 50 are placed imbetween sheets 25 and 26 and between seams 30, 32, 34, 36 and 48 in panels 4, 6, 8 and 10 and flap 20 respectively. The inserts 50 may be made from any soft, pliable material such as flexible polyurethane foam. Each insert has an area slightly smaller than the panel the insert is placed within providing support and definition to each panel, making the panels easily hingible about seams 30, 32, 34 and 36. Each insert is also sized slightly smaller than each corresponding panel to prohibit the insert from shifting in location within the panel. The inserts 50 protect the articles 3 when the holder and carrier 1 is in an article carrying position as shown in FIGS. 1, 2 and 6 by providing a shock absorbing surface if the holder 1 is dropped or bumped into other objects.

Compartment means such as pockets or pouches 52, 54, 56 and 58 located within the article holder and carrier 1 are formed by sewing or otherwise fixedly attaching a generally rectangular sheet of pocket material 60 to the inner sheet 25 across wall panels 6, 8 and 10 at base seam 62. The individual pockets 52, 54, 56 and 58 are formed by sewing pocket material 60 to sheet 25 at seams 64, 66, 68, 70 and 72 respectively. Seams 64, 66, 68, 70 and 72 are perpendicular to base seam 62 and extend between seam 62 and seam 48. Pockets 52, 54 and 58 include gathers or pleats 74 along base seam 62 to provide the proper pocket width to custom fit the articles 3, such as glue 77 or crayons 78. Pocket 56 used for holding pens and pencils 79 does not require pleats or gathers 74, but it is forseen that pleats or gathers may be included in any pocket depending on the expected use thereof, resulting in each pocket fitting closely around an article being held therein with each pocket proportioned in relation and cooperation with each other pocket so that when the article holder and carrier is filled with articles 3, and the holder and carrier 1 is in the carrying position shown in FIGS. 1, 2 and 6, the space within the holder and carrier 1 is filled, creating a rigid, compact, box-like structure. The custom fit pockets 52, 54, 56 and 58 hold the articles 3 against the wall panels 6, 8 and 10, utilizing the rigidity of the articles to provide rigid support for the wall panels. When the article holder and carrier 1 is in the folded, article carrying positions as shown in FIGS. 1, 2 and 6, the material 60 of pockets 52 and 54 abut the material 60 of pocket 58, compactly holding articles 3 in place within the pockets of the holder and carrier 1.

Additional pieces of material forming article receptacles may be sewn or otherwise fixedly attached onto the sheet 60 of pockets 52, 54, 56 and 58, such as a rectangular sheet of material 81 that forms a pocket or pouch 82 to hold scissors 83. The pocket materials 60 and 81 are made of flexible, washable materials such as fabric or plastic similar to the inner and outer wall sheets 25 and 26.

The base wall or panel 12 is sewn or otherwise hingedly attached to wall panel 10 at edge 85. The base wall 12 and base flap 22 are constructed by sewing an inner base sheet of material 88 to an identically shaped outer base sheet 90. Sheets 88 and 90 are made from a washable fabric or flexible plastic material similar to inner and outer wall sheets 25 and 26. The base wall 12 is partitioned or hingedly separated from the base flap 22 by sewing sheet 88 to sheet 90 at seam 92 that corresponds with outer edge 94 of the article holder and carrier 1 when in a folded article carrying position as shown in FIGS. 1 and 2. Shock absorbing flexible inserts 50 are also placed imbetween sheets 88 and 90 inside both the base wall 12 and the base flap 22.

Figure 3:
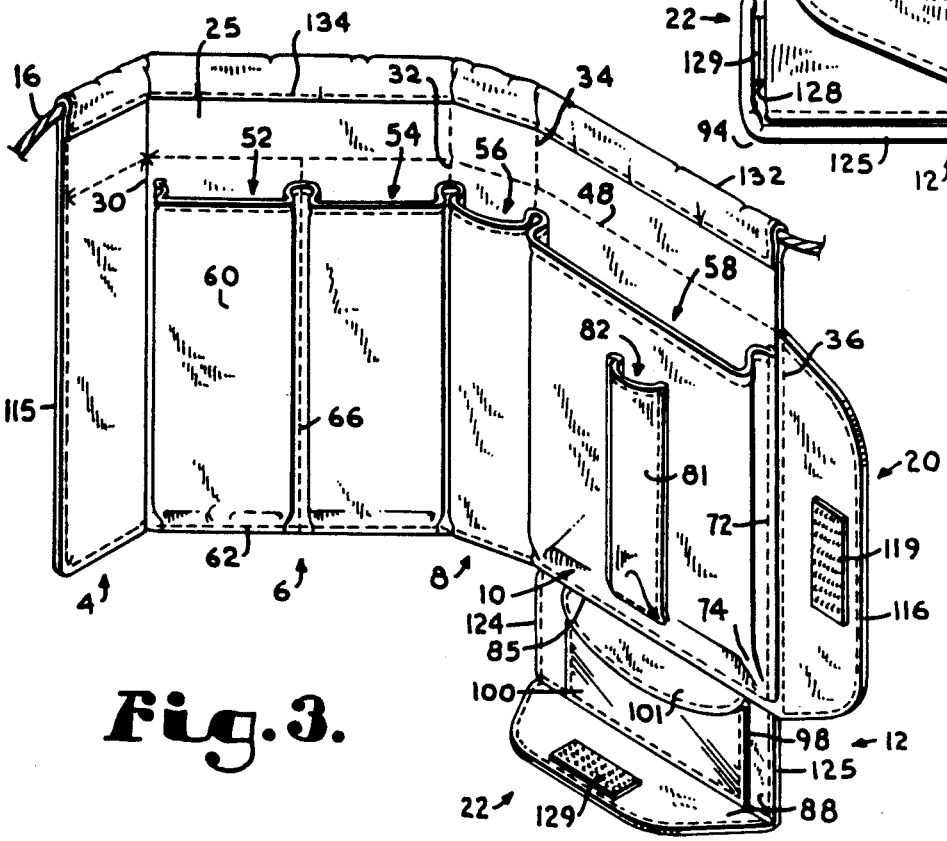
FIG. 3 is a perspective view of the article holder and carrier shown in an unfolded, article remove/deposit position.
Figure 4:
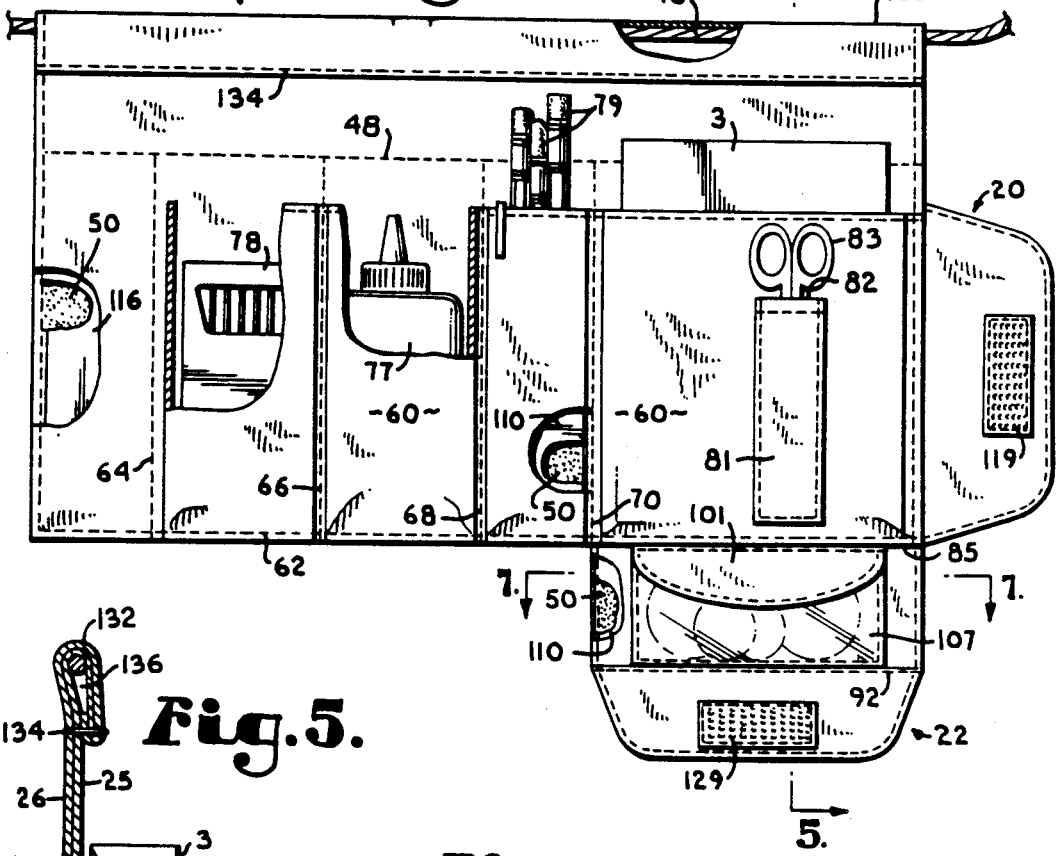
FIG. 4 is a top plan view of the article holder and carrier shown in an unfolded, article remove/deposit position with portions broken away to show the detail thereof.
Figure 5:
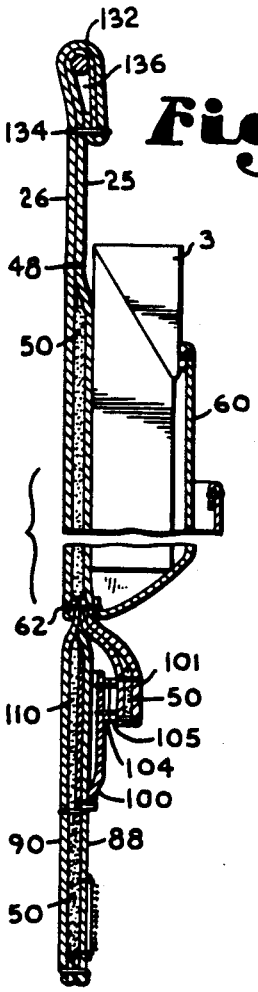
FIG. 5 is a cross-sectional view of the article holder and carrier taken along 5—5 of FIG. 4.

Compartment means such as a coin compartment or purse 98 is sewn or otherwise fixedly attached to sheet 88 of the base wall 12. The coin holding portion 100 of the coin purse 98 is made from a clear plastic material or may be made from a washable fabric. The fabric coin purse closure member 101 is sewn or otherwise fixedly attached to sheet 88 of base wall 12 near edge 85. The coin purse 98 therefore opens in the same direction as pockets 52, 54, 56 and 58 when the article holder and carrier 1 is in an unfolded article remove/deposit position as shown in FIGS. 3, 4, 5 and 7. The two-ply closure member 101 includes a shock absorbing flexible insert 50 therebetween as shown in FIG. 5. Hook and loop fastening means such as fasteners 104 and 105 are sewn or otherwise adhered to portion 100 and closure member 101 respectively allowing a user to secure the closure member 101 to the coin holding portion 100 securing items 107 held within. The weight of items 107 provide added stability to the article holder and carrier 1 when the carrier is stored in a generally verticle position as shown in FIGS. 1 and 2 with the base panel 12 resting on a horizontal surface (not shown).

The base wall 12, wall panel 4 and wall panel 8 include inner stiffening partitions 110 to provide added support and rigidity to the article holder and carrier 1. The partitions 110 are located between flexible inserts 50 and inner sheet 25 in wall panels 4 and 8 and imbetween flexible insert 50 and inner base sheet 88 in base wall 12. The partitions 110 are approximately the same size as the adjacent respective inserts 50 and are made from semi-rigid plastic such as high-density polyethylene.

When in a folded position as shown by FIGS. 1, 2 and 6, edge 115 of wall panel 4 abuts and is generally perpendicular to the inner sheet 25 at seam 36 that partitions panel 10 from flap 20. Flap 20 folds over wall panel 4 with an edge 116 of flap 20 near edge 40 and outer sheet 26 of panel 4 adjacent to inner sheet 25 of flap 20. Fastening means such as hook-and-loop fasteners 118 and 119 are sewn or otherwise fixedly attached to outer sheet 26 of wall panel 4 and to inner sheet 25 of flap 20 respectively, securing flap 20 to panel 4.

Also, when in a folded position as shown by FIGS. 1, 2 and 6, a lower edge 122 of panels 4, 6 and 8 abuts the inner sheet 88 of base panel 12 at edges 124 and 125 and seam 92 with panels 4, 6, 8 and 10 generally perpendicular to base panel 12. Flap 22 folds over wall panel 6 at edge 94 with the outer sheet 26 of panel 6 adjacent to the inner sheet 88 of flap 22. Fastening means such as hook-and-loop fasteners 128 and 129 are sewn or otherwise fixedly attached to outer sheet 26 of wall panel 6 and to inner sheet 88 of base flap 22 respectively, securing flap 22 to panel 6. Although the box-like container formed by folding flap 20 over wall panel 4 and flap 22 over wall panel 6 is not sealed at base edges 124 and 125, the article holder and carrier 1 provides a secured container for the articles 3 therein because the pockets 52, 54, 56 and 58 open in a direction opposite base panel 12. It is forseen that hook-and-loop fasteners 104, 105, 118, 119, 128 and 129 may be replaced by snaps, bottons, zippers or other types of closure members.

The top portion 14 of the article holder and carrier 1 includes a top opening 130 closable by a closure means such as a drawstring closure 131 formed by folding the top portion 14 at a top edge 132 and sewing the top portion 14 to the inner sheet 25 at seam 134 forming a channel 136. Drawstring 16 slidingly courses through channel 136 with drawstring ends 136 tied or otherwise fixedly connected creating a loop 137.

In operation, the article holder and carrier 1 may be transported in the folded, closed, box-like container configuration as shown in FIGS. 1, 2 and 6 with the top portion 14 tightly gathered together along the drawstring 16 substantially closing the top opening 130. A user may clasp the drawstring loop 137 to carry the article holder and carrier 1. The articles 3 are compactly held within the article carrier and holder 1 when in the closed position with the articles 3 providing rigidity to side wall panels 6, 8 and 10 and base wall 12.

The article holder and carrier 1 may be placed in three different positions for removing or depositing articles 3. If all the articles 3 are to be accessed, a user may grasp and pull side wall flap 20 and base flap 22 from side walls 4 and 6 respectively, disconnecting hook-and-loop fastener 119 from fastener 118 and fastener 129 from fastener 128. The user may then unfold the article holder and carrier 1 into a generally flat position as shown in FIGS. 3 and 4, with inner sheet 25 facing upward, exposing pockets 52, 54, 56, 58 and 82 and coin purse 98. As the article holder and carrier 1 is unfolded, the top portion 14 ungathers with the drawstring 16 sliding within the channel 136.

All articles 3, with the exception of coin purse 98 may be accessed at opening 130. A user may choose to keep the hook-and-loop fasteners in a closed position as shown in FIGS. 1, 2 and 6 and open only the top portion 14 by sliding the top portion 14 at channel 136 along the drawstring 16 until no gathers or wrinkles remain in the material of top portion 14.

If a user requires access to the coin purse only, hook-and-loop fastener 129 may be released from hook-and-loop fastener 128 with the rest of the box retained in a closed position. Hook and loop fastener 105 is then detached from hook-and-loop fastener 104 to provide access to the items 107 within the coin purse 98. If a user fails to re-connect fasteners 104 and 105 and fasteners 128 and 129 and carries the article holder and carrier 1 by the drawstring 16, the coin holding portion 100 of the coin purse 98 swings to a vertical position with the opening of the coin holding portion 100 at the top thereof, retaining the articles 107 therein.

To place the article holder and carrier 1 in an article carrying position, a user folds the wall panels to a box-like configuration, attaches fastener 119 to fastener 118 and fastener 129 to fastener 128 and pulls on the drawstring 16 at ends 136, gathering the top portion 14.

It is to be understood that while certain forms of the present invention have been illustrated and described herein, it is not to be limited to the specific forms or arrangement of parts described and shown.

What is claimed and desired to be secured by Letters Patent is as follows:

1. An article holder and carrier comprising:

(a) first, second, third and fourth fabric side walls; said first side wall hingedly connected to said second side wall; said second side wall hingedly connected to said third side wall; said third side wall hingedly connected to said fourth side wall;

(b) a fabric base wall hingedly connected to said first side wall; said walls being hingable between an article carrying position, a first article remove/-deposit position and a second article remove/-deposit position; said first side wall attached to said fourth side wall and said third side wall attached to said base wall when said walls are in said article carrying position; said first side wall attached to said fourth side wall and said third side wall detached from said base wall when said walls are in said first article remove/deposit position; said first side wall detached from said fourth side wall and said third side wall detached from said base wall when said walls are in said second article remove/-deposit position; and (c) first fastening means for attaching said first side wall to said fourth side wall including:

(1) a first flap hingedly connected to said first side wall having a first hook-and-loop fastener fixedly attached thereto; and (2) a second hook-and-loop fastener fixedly attached to said fourth side wall;

(d) second fastening means for attaching said third side wall to said base wall including:

(1) a second flap hingedly connected to said bse wall having a third hook-and-loop fastenre fixedly attached thereto; and (2) a fourth hook-and-loop fastener fixedly attached to said third side wall;

(e) a plurality of pockets fixedly attached to said first, second and third side walls; said pockets being adapted to hold rigid articles against said side walls providing support therefore when said walls are in an article carrying position;

(f) a compartment fixedly attached to said base wall;
(f) shock absorbing insert means located within said first, second, third and fourth side walls and said base wall;
(h) a drawstring closure integral with said first, second, third and fourth side walls; and
(i) a pouch fixedly attached to at least one of said pockets.

2. An article holder and carrier comprising:
a. first, second, third and fourth side walls; said first side wall hingedly connected to said second side wall; said second side wall hingedly connected to said third side wall; said third side wall hingedly connected to said fourth side wall;
b. a base wall hingedly connected to said first side wall; said walls being hingedly movable between an article carrying position and an article remove/-deposit position; said first side wall being attached to said fourth side wall, said third side wall being attached to said base wall and said first, second, third and fourth side walls forming an opening when said walls are in said article carrying position; and
c. first fastening means for attaching said first side wall to said fourth side wall;
d. second fastening means for attaching said third side wall to said base wall; said fastening means including:
(1) a flap hingedly connected to said base wall having a first hook-and-loop fastener fixedly attached thereto; and
(2) a second hook-and-loop fastener fixedly attached to said third side wall;
e. compartment means fixedly attached to said first, second and third side walls and said base wall; and
f. closure means integral with said first, second, third and fourth side walls at said opening when said walls are in said article carrying position.

3. An article holder and carrier comprising:
a. first, second, third and fourth side walls; said first side wall hingedly connected to said second side wall; said second side wall hingedly connected to said third side wall; said wall hingedly connected to said fourth side wall;
b. a base wall hingedly connected to said first side wall; said walls being hingedly movable between an article carrying position and an article remove/-deposit position; said first side wall being attached to said fourth side wall, said third wall being attached to said base wall and said first, second, third and fourth side walls forming an opening when said walls are in said article carrying position; and
c. first fastening means for attaching said first side wall to said fourth side wall;
d. second fastening means for attaching said third side wall to said base wall;
e. compartment means fixedly attached to said first, second and third side walls and said base wall; and
f. a drawstring closure integral with said first, second, third and fourth side walls at said opening when said walls are in said article carrying position.

* * * * *